US006778045B2

(12) United States Patent
Orr

(10) Patent No.: US 6,778,045 B2
(45) Date of Patent: Aug. 17, 2004

(54) TELECOMMUNICATION RELAY ARRAY FOR DSL NETWORK CONFIGURATON

(75) Inventor: Bruce Francis Orr, Balgowlah (AU)

(73) Assignee: Alcatel, Paris (FR)

( * ) Notice: Subject to any disclaimer, the term of this patent is extended or adjusted under 35 U.S.C. 154(b) by 58 days.

(21) Appl. No.: 10/096,725

(22) Filed: Mar. 14, 2002

(65) Prior Publication Data

US 2002/0186109 A1 Dec. 12, 2002

(30) Foreign Application Priority Data

Mar. 15, 2001 (AU) ..... 28005/01

(51) Int. Cl.[7] ..... H01H 51/22
(52) U.S. Cl. ..... 335/78; 200/181; 336/200
(58) Field of Search ..... 335/78, 83, 124, 335/128; 200/181; 361/233; 257/414, 421, 531–2, 528; 336/200

(56) References Cited

U.S. PATENT DOCUMENTS 3,898,595 A 8/1975 Launt
5,472,539 A * 12/1995 Saia et al. ..... 156/155
5,742,012 A * 4/1998 Franzke et al. ..... 200/5 A
6,016,092 A * 1/2000 Qiu et al. ..... 333/262
6,410,360 B1 * 6/2002 Steenberge ..... 438/52

FOREIGN PATENT DOCUMENTS

DE 10031569 A1 2/2001
GB 1 451 451 10/1976

* cited by examiner

*Primary Examiner*—Lincoln Donovan
(74) *Attorney, Agent, or Firm*—Sughrue Mion, PLLC

(57) ABSTRACT

This invention provides an electromagnetic relay formed on a substrate (1), preferably a multi-layer printed circuit board. The magnetic circuit (4, 5, 6*a*, 6*b*, 7*a*, 7*b*) passes through holes (2, 3) in the substrate, and is formed using printed circuit manufacturing techniques, such as electroplating to manufacture the plated through holes. The armature 7*b* is formed by depositing the armature material on a temporary layer, which is then removed.

15 Claims, 5 Drawing Sheets

TELECOMMUNICATION RELAY ARRAY FOR DSL NETWORK CONFIGURATON

TECHNICAL FIELD

This invention relates to a novel construction for a micro relay. The invention will be described in the context of an array of micro relays. One application of such a device is in the controllable connection between a plurality of telephone subscriber lines and a plurality of lines to an exchange.

Such connections are typically executed using labor intensive, manually fitted wire pair jumpers typically located at at least two points between the exchange and the customer. The first jumpering point is the main distribution frame (MDF) typically located in the same building as the exchange. The second jumpering point is typically located in an outdoor cabinet or pillar near the customers. In some cases further jumpering may occur near the customer, eg. in sealed underground canisters located in small pits. The invention is suitable for application at any of these points.

The jumpers are used to connect or disconnect customer services as required, while maintaining efficient use of the cable pairs between the customers and the exchange, i.e., only using the valuable exchange pairs for active services.

In the case of the use of digital loop concentrators (DLC, an outdoor cabinet remote multiplexer) the MDF function is replaced by a cross connect field typically located within the DLC.

BACKGROUND ART

Relays are still used extensively in the telecommunication industry, for example, in telephone exchanges for line testing and application of ring voltage. Usually, these devices have been discrete devices, not manufactured in large arrays, and assembled from discrete components.

In the past, the main means of altering remote jumper connections was by physically changing the copper connections at a cabinet/pillar to which several customer copper connections were connected. This required a service person to travel from a depot to the location of the cabinet/pillar, identify the connections to be changed, and physically make the change before returning to the depot. This sequence of events is referred to colloquially as a truck-roll.

The advent of services such as ADSL creates an increased need for the ability to rapidly and efficiently change the customer connections.

In order to provide remotely controllable links between groups of lines, typically large matrices of relays are required. Conventional relays are not cost or space effective in this application. The present invention offers a means of fabricating large arrays of relays in compact form and with very low cost.

SUMMARY OF THE INVENTION

This invention proposes a micro relay device including a magnetic path formed of a movable armature at least partly of magnetizable material the magnetic path including magnetizable material carried by a support member, the support member including one or more through holes to permit the magnetic path to pass from a first side of the support member to a second side, the armature being proximate to the first side, the magnetic path extending along or proximate to the second side. Preferably the support member is in the form of a planar substrate.

The activation coil or coils for the relay are installed on or in the support member, and pass through a loop of the magnetic path.

The movable armature may be a cantilever, a meander, a spiral spring, or other suitable resilient structure. One embodiment includes a flexible membrane carrying a magnetic component and electrical contacts.

In a preferred embodiment, the invention provides a remotely switchable relay array to change subscriber connections.

DETAILED DESCRIPTION OF THE INVENTION

The invention will be described with reference to the drawings.

Figure 1:
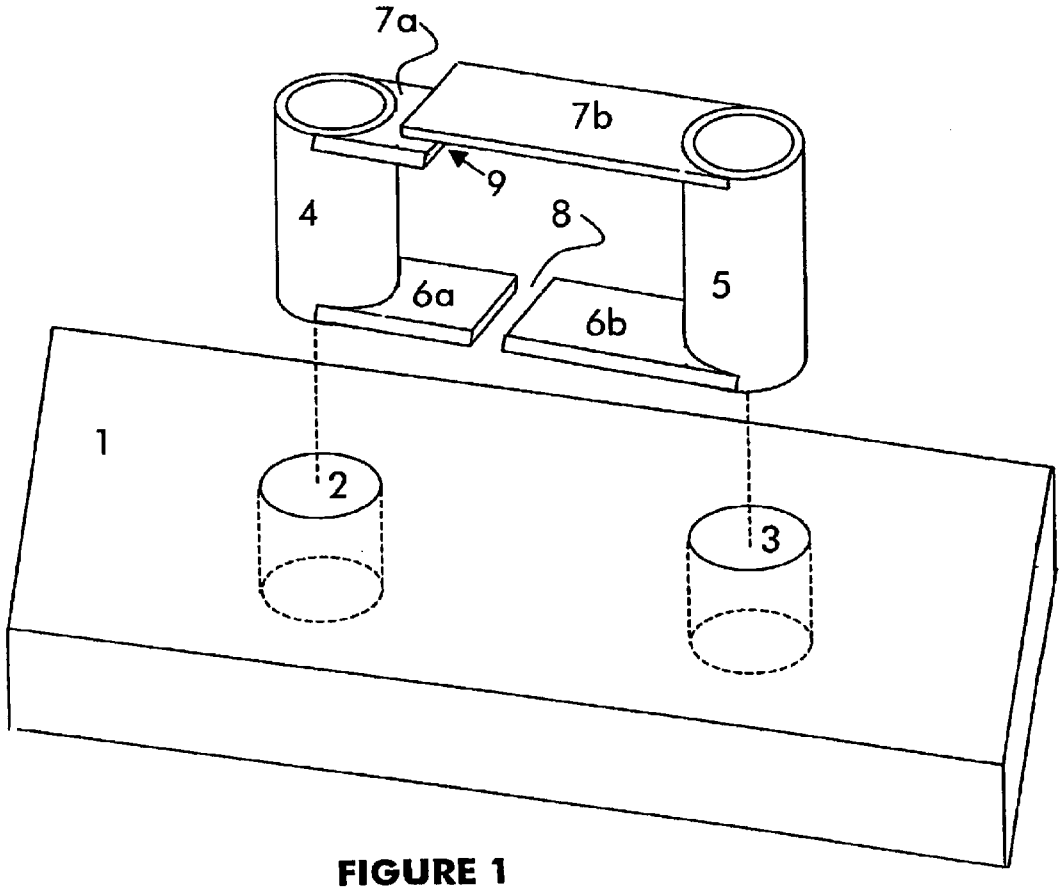
FIG. 1 is an exploded view of an embodiment of the micro relay with the operating coil(s) omitted for clarity.

FIG. 1 shows an exploded view of a preferred embodiment of the invention having the magnetic path and activation coils installed on or in the support member, 1. The activation coils are not shown in this figure for the sake of simplifying the view. The support member is preferably a PCB. The magnetic path consists of a lower transverse member divided into two parts, 6*a*, 6*b*, by air or insulating gap 8, and an upper transverse member divided into two parts, 7*a*, 7*b*, which are vertically non-aligned and horizontally overlapping to provide a contact gap 9. The part 7*a* forms a contact pad, and the part 7*b* forms the flexible relay armature. The vertical gap is provided in this embodiment by extending the vertical pillar 5 to which the armature 7*b* is attached.

Preferably, the armature is made of nickel. Nickel has suitable magnetic, electrical conductive, flexiblity and resilience characteristics for the present purpose. Nickel is also preferred for the remainder of the magnetic path as it is amenable to many current PCB fabrication processes.

The air gap 8 serves two functions. It provides electrical isolation between the contact pad 7*a* and the armature 7*b* when the relay contacts are in the open state, and it provides a gap in the magnetic path across which a latching magnetic field from a permanent magnet can be applied.

In a preferred embodiment, a latching magnetic field is applied across the air gap. In the relay array to be described below, the magnetic field is provided by a flexible sheet magnet, akin to the "fridge magnet", which is used to avoid the need for individual magnets for each relay. Flexible sheet magnets are typically magnetized with alternating north/south poles in stripes. The stripe spacing may be adjusted to suit the pitch of the relays in the array. Alternatively, more tailored magnetic biasing may be achieved by a custom moulded profile for the sheet magnet e.g., by forming thicker sections at the air gaps.

A preferred method of fabricating a suspended or overhanging member such as armature 7*b* will also be described. A preferred method of fabricating a suspended or overhanging member, such as a fly-over or cantilever, includes applying a removable layer of a first material, forming the member of a second material on the removable layer, and removing at least part of the removable layer, e.g., by dissolving or etching. The removable layer may be for example metal such as aluminium or zinc, or a plastic material.

In one embodiment, the member is formed by placing or depositing an overlay layer of the second material on the removable layer, and forming the member from the overlay layer, for example by masking and etching. The overlay layer may be for instance a thin foil or may be electroplated.

In an alternative embodiment, the cantilever member is formed by applying a seed layer to the removable layer (if required), applying a mask layer on top of the seed layer, and electroplating through the mask.

The support for the end of the cantilever is preferably formed by drilling or punching through the removable layer and support layer and depositing magnetic material in the so formed hole e.g., by electroplating. After removal of the removable layer the cantilever is suspended above the support member at a height determined by the thickness of the removable layer.

In a further embodiment the dissolvable layer may be eliminated, and the cantilever beams are then fabricated separately, e.g., etching from foil, and then attached to the associated magnetic through hole either with or without a spacer member.

Using the processes described above, arrays of relays can be fabricated in PCB plants with minimal modifications to standard PCB processing. This allows substantial cost savings, compared to conventional micro-machining techniques, and allows very large size arrays to be produced if required.

Figure 2:
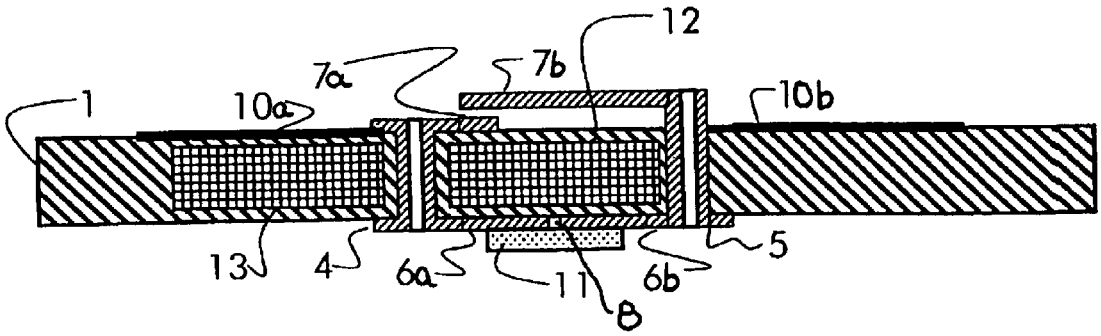
FIG. 2 is an elevation cutaway view of the preferred embodiment as in FIG. 1 including also the operating coil(s) and optional bias magnet.

FIG. 2 shows a cross-section through a relay built on a PCB having 2 or more layers. The same numbers have been used to identify the same features previously discussed. The support member 1 is a multi-layer PCB having the vertical magnetic elements 4 and 5 formed in through holes 2 and 3, e.g., by through-plating techniques. The magnetic path elements 6*a* and 6*b* are formed on the bottom surface of the PCB. The armature 7*b* is connected to the top of vertical member 5. A contact track 10*b* is in electrical connection to the end of armature 7*b* on the surface of the PCB. The contact pad 7*a* is similarly connected to a contact track 10*a*.

A permanent magnet 11 bridges the air or insulation gap 8 on the bottom of the PCB.

One or more electrical coils 12,13 may be provided between the layers of the PCB. When a current is passed through the coil(s), the electromagnetic force causes armature 7*b* to be attracted to contact pad 7*a* and to make electrical contact with contact pad 7*a*. In the absence of the permanent magnet, the armature returns to its original position under its own resilience when the actuating current is stopped.

When the magnet 11 is in place, the armature is held in position by the force of the magnet 11. To release the armature, a reverse current pulse is sent through the coils to create an opposite electromagnetic force to cancel the force of the magnet 11 sufficiently to permit the armature resilience to restore the armature to the open position.

The relay may thus be set or reset using short pulse of current e.g., 10 ms pulse length. No continuous power is required to maintain the relay in the set or reset state.

In an alternative embodiment, where the armature or contact pad is a flexible permanent magnet foil or has a permanent magnet at the contact point, the reverse current can be used to produce an electromagnetic force tending to positively force open the contacts.

The invention is suitable to provide an array of closely packed miniature relays, and this embodiment will now be described with reference to the drawings.

Figure 3:
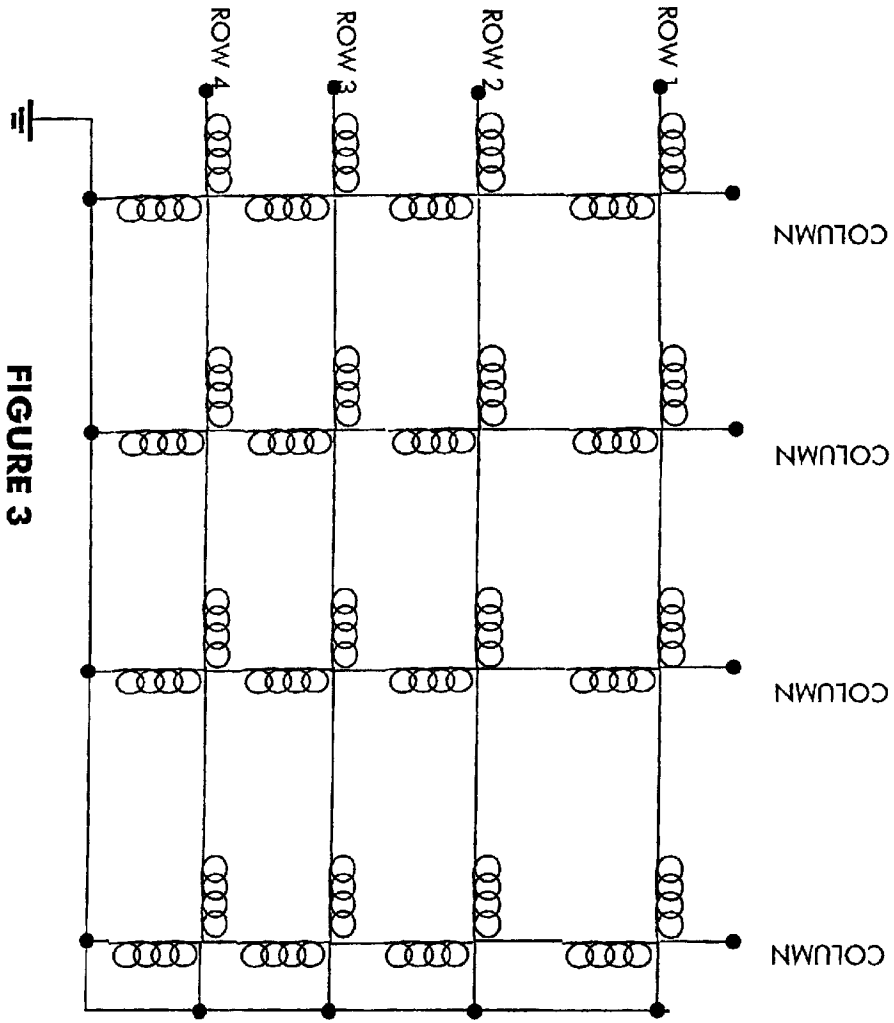
FIG. 3 illustrates the concept of row and column addressing to operate a selected relay.

FIG. 3 illustrates the concept of an array of coils arranged in row and column pairs configuration. These pairs of coils are intended to be activated together, the combined row and column current being sufficient to trip the relay at the junction of the activated row and column, while, at the same time the current applied to the other coils in a row or a column coil is insufficient to trip a relay. The advantage of using row and column addressing is that the number of address lines required is reduced in comparison with individual addressing of each relay. In this figure for explanatory purposes the coils are shown as individual coils for each relay, however in the preferred embodiments described herein the coils are shared (extended) over multiple relays. In one embodiment, a single turn loops all the relays in a row or column.

The concept of multiple coils can be extended by providing additional coils, e.g., along the diagonals of the array, so that 3 or 4 coils can be used to address a single relay. Such a configuration has the advantage of increasing the discrimination between the selected relay and the other relays in the row or column of the selected relay.

Figure 4:
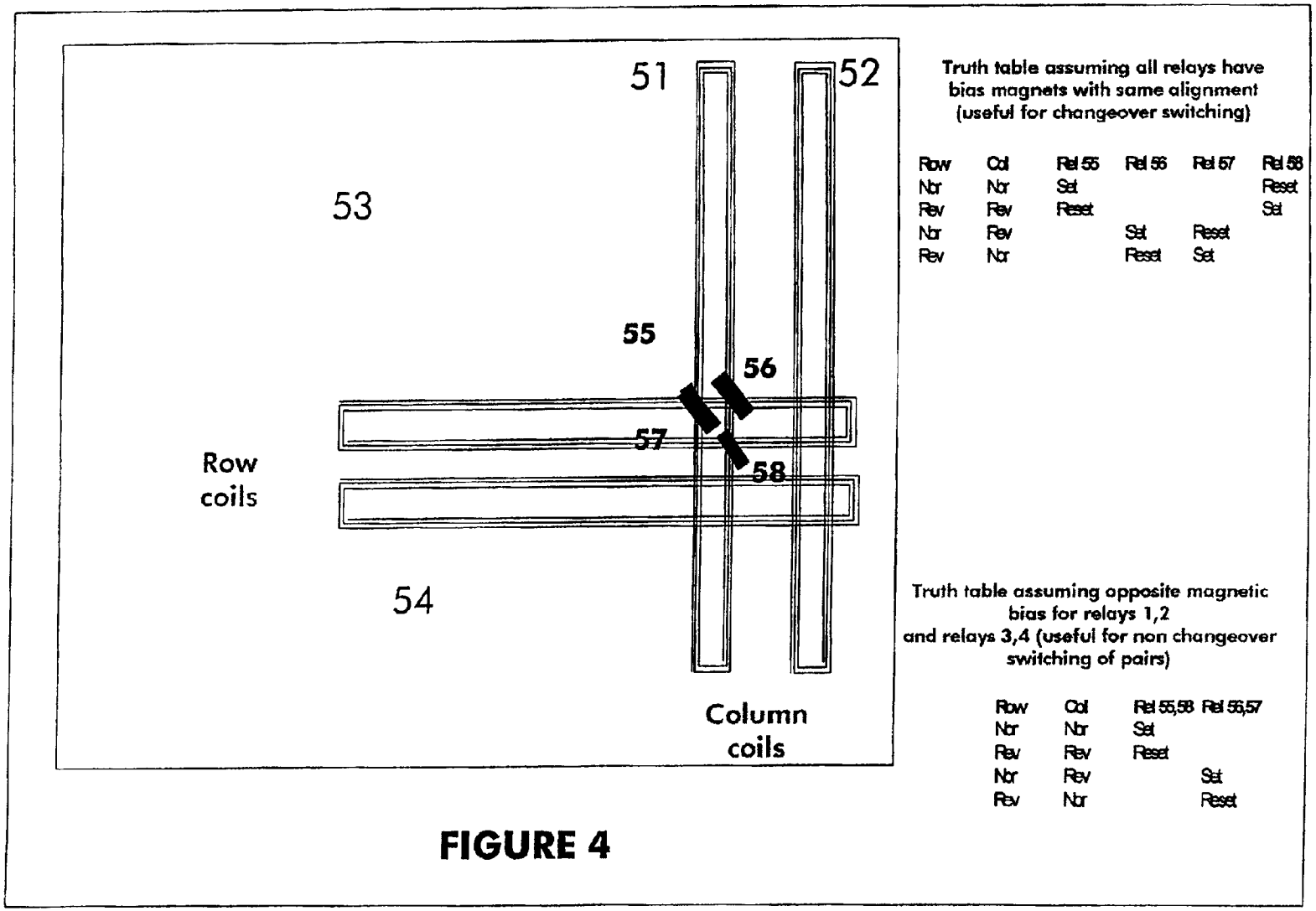
FIG. 4 illustrates an embodiment of the invention using a single coil for each row or column.

FIG. 4 shows a preferred embodiment in which each row or column is operated by a single coil looping all the relays in the particular row or column. This configuration simplifies the manufacturing processes needed to form the coils and enables greater packing density.

FIG. 4 shows a remotely controllable relay array in which each of the relays is addressable (activatable) by at least two coils, wherein the first coil current partially energizes, but does not trip a first plurality of relays, and the second coil current partially energizes, but does not trip a second plurality of relays, the relay to be operated being common to the first and second pluralities, the aggregate of the first and second currents being sufficient to trip the target relay.

In the embodiment shown in FIG. 4, which is a partial view showing only two columns and two rows of a multi-column, multi-row array, two column coils, 51 and 52, and two row coils, 53 and 54, are shown. At the four intersections of coils 51 and 53, there are corresponding relays, 55, 56, 57, and 58. In the full array, relays may be located at all intersections, but only four relays are shown for the sake of clarity. The truth tables associated with FIG. 4 show the switching patterns for the relays assuming:

1) the relays all have the same magnetic bias alignment;

2) the relays 55 and 58 have opposite bias to relays 56 and 57.

By applying forward or reverse current to the coils, the switching patterns shown in the truth tables can be achieved.

Truth table 1 assuming all relays have bias magnets with the same alignment (useful for changeover switching)

| Row | Col | Rel 55 | Rel 56 | Rel 57 | Rel 58 |
|---|---|---|---|---|---|
| Nor | Nor | Set | | | Reset |
| Rev | Rev | Reset | | | Set |
| Nor | Rev | | Set | Reset | |
| Rev | Nor | | Reset | Set | |

Truth table 2 assuming opposite magnetic bias for relays 55 & 58 relative to and relays 56 & 57 (useful for non changeover switching of pairs)

| Row | Col | Rel 55, 58 | Rel 56, 57 |
|---|---|---|---|
| Nor | Nor | Set | |
| Rev | Rev | Reset | |
| Nor | Rev | | Set |
| Rev | Nor | | Reset |

In FIG. 4, each relay includes a magnetic circuit which includes a substantially closed loop magnetic path and wherein the row and column currents pass through the inside of the loop of the respective row and column relays.

Figure 5:
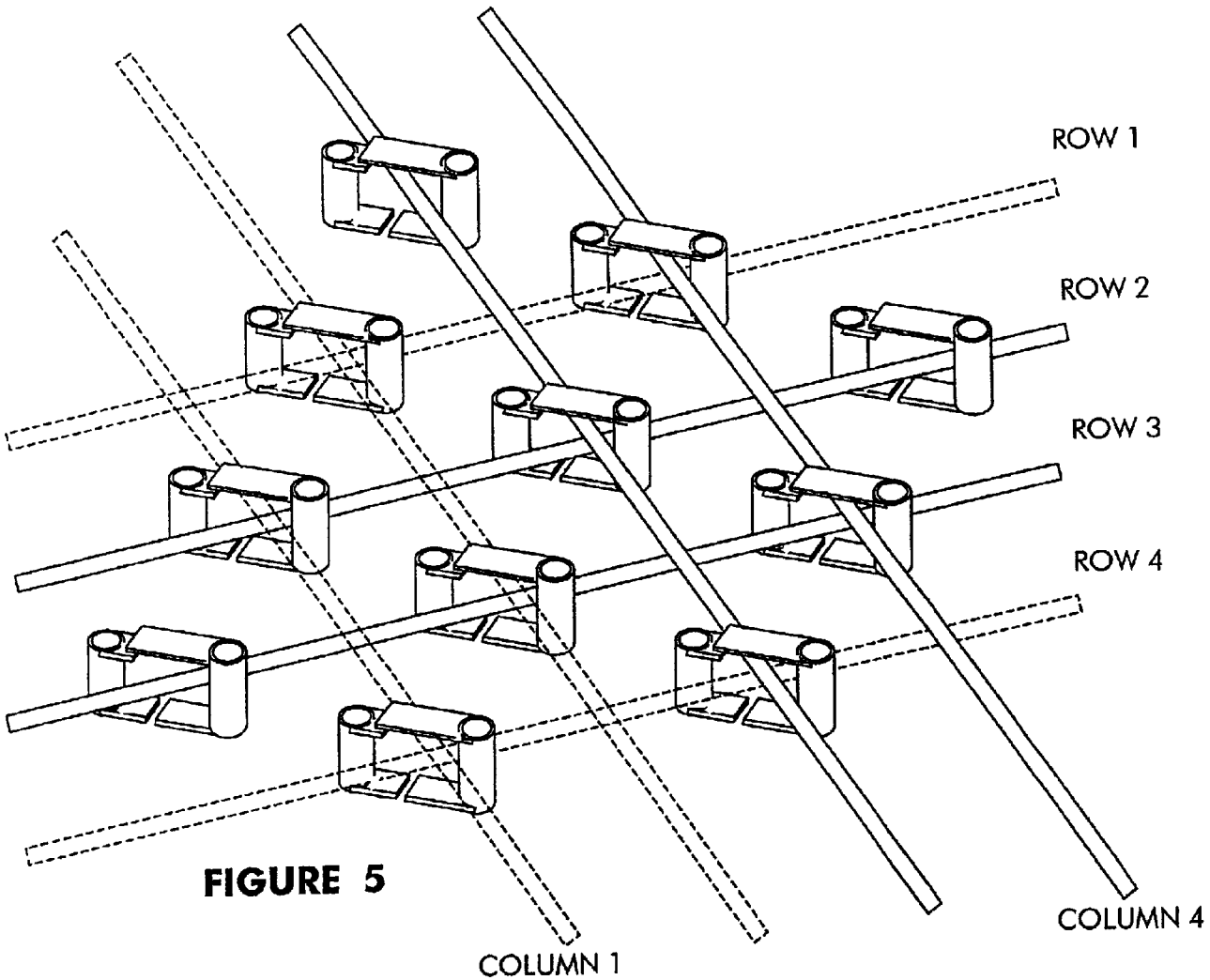
FIG. 5 illustrates the magnetic ang control paths for an array of relays.

In a further embodiment shown in FIG. 5, each row coil is a single turn coil. In addition, each column coil is formed of a single turn. In this embodiment, the current is proportionately larger than in the case where the coils have multiple turns Thus a single coil may require, eg, 10 amps, while a 50 turn coil would require only one fiftieth of this. Using single turn row and column coils, the number of PCB layers may be reduced with associated cost savings.

In FIG. 5, relays are shown only at alternative intersections of the row and column conductors. This is done for the sake of clarity. In a high density embodiment, relays would be located at each intersection.

In the embodiment shown in FIG. 5, the activating coil for each row or column includes a single conductor passing through the magnetic paths of the relays in the corresponding row or column. The PCB is not shown so that the address coils can be seen clearly. The return path may be via a common ground conductor located, for example, on another inter-layer plane, or there may be individual return paths for each coil either on the same plane or on a different inter-layer plane, while a third option provides a common return path on the same plane. An alternative which gives flexibility in controlling the direction of current through a coil is to have the ends of the single track connected to a push-pull driver so that current can be fed through the track in either direction without the need for a bi-polar power supply which would be required if one end of the conductors were to be earthed.

Figure 6:
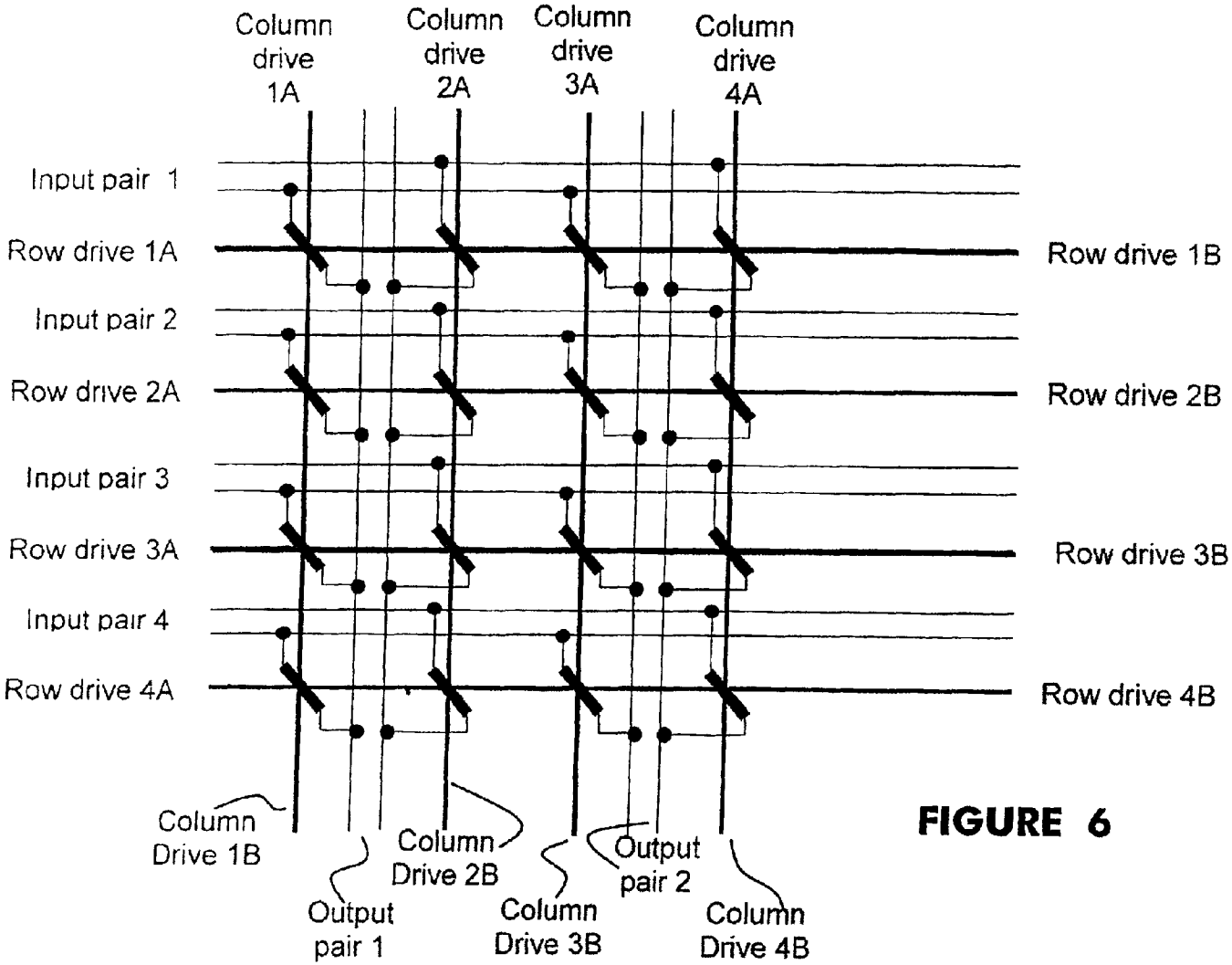
FIG. 6 illustrates an array for switching pairs of wires.

FIG. 6 shows an implementation of the invention for switching a pair of input wires to a pair of output wires.

In FIG. 6, the heavy lines represent the row and column control coils, and the light lines represent the input and output pairs. As shown, any one of the row input pairs can be connected selectively to any one of the column output pairs, assuming a square matrix. In some applications, it may be advantageous to have more output pairs than input pairs, eg, in the case where the input pairs are exchange lines, and the output pairs are customer lines.

What is claimed is:

1. A micro relay device comprising:

a single support member;

a magnetic path formed of a movable, flexible armature at least partly of magnetizable material, the magnetic path including magnetizable material carried by said support member, the support member including first and second plated through holes to permit the magnetic path to pass from a first side of the support member to a second side, the armature being proximate to the first side and being attached at one end thereof to said first plated through hole; and a fixed contact attached to said second plated through hole, the magnetic path extending between said through holes on the second side.

2. A device as claimed in claim 1, wherein the support member is in the form of a planar substrate.

3. A device as claimed in claim 1, wherein the magnetic path on the second side includes an air gap, and wherein a bias magnet is applied across the air gap.

4. An array of relays as claimed in claim 1, sharing a common sheet magnet applied to the second side.

5. A device as claimed in claim 1, wherein the armature is a cantilever made from flexible permanent magnet material.

6. A device as claimed in claim 1, wherein activation coils are installed on or in the support member.

7. The array as claimed in claim 4, in which each of the relays is addressable by at least first and second current paths, wherein a first current in the first current path energizes but does not trip a first plurality of relays, and a second current in the second current path energizes but does not trip a second plurality of relays, a target relay to be operated being common to the first and second pluralities, and the aggregate of the first and second currents being sufficient to trip the target relay.

8. An array as claimed in claim 7 in which the relays are arranged in rows and columns, and wherein the first current is a row current and the second current is a column current.

9. The array as claimed in claim 8, wherein each relay includes a magnetic circuit which includes a substantially closed loop magnetic path, and wherein the row and column currents pass through the inside of the loop of the respective row and column relays.

10. The array as claimed in claim 8, wherein the relays in each row are energized by a shared row coil, and the relays in each column are energized by a shared column coil.

11. The array as claimed in claim 8, each relay including in said magnetic path an insulating, non-magnetic gap, and there being a sheet magnet having a magnetic field bridging each gap.

12. The device according to claim 1, comprising a relay having a coil which is divided into two or more sub-coils, wherein each sub-coil can be energised individually, the current in each sub-coil being limited so that the force of one sub-coil is insufficient to activate the relay, and wherein the additive force of two of the sub-coils is sufficient to activate the relay.

13. The device as claimed in claim 12, in which the sub-coils are arranged to permit row and column activation.

14. The device as claimed in claim 12, wherein each relay includes three sub-coils arranged for row, column, and diagonal activation.

15. A micro relay device including a support member, first and second through holes containing magnetic material and traversing first and second sides of said support member, at least one fixed contact on said first side, a moving armature formed at least partly of magnetic material located proximal to said first side, a magnetic return path located proximal to said second side and at least one electrical activation path located within or on the surface of said support member.

* * * * *